US005235562A

United States Patent [19]

Vaucher

[11] Patent Number: 5,235,562

[45] Date of Patent: Aug. 10, 1993

[54] TIMEPIECE OF THE MECHANICAL AND/OR ELECTROMECHANICAL TYPE HAVING AUTOMATIC BACKWARD MOVING DISPLAY MEANS

[75] Inventor: Frank Vaucher, Cormoret, Switzerland

[73] Assignee: Compagnie des Montres Longines, Francillon S.A., St-Imier, Switzerland

[21] Appl. No.: 991,562

[22] Filed: Dec. 16, 1992

[30] Foreign Application Priority Data

Dec. 28, 1991 [CH] Switzerland ..... 03859/91

[51] Int. Cl.[5] ..... G04B 19/24; G04C 3/00

[52] U.S. Cl. ..... 368/28; 368/76

[58] Field of Search ..... 368/28, 37, 76, 80, 368/220, 223

[56] References Cited

U.S. PATENT DOCUMENTS

| | | | |
|---|---|---|---|
| 1,846,962 | 2/1932 | Gries | 368/37 |
| 3,842,590 | 10/1974 | Kato | 368/28 |
| 4,232,510 | 11/1980 | Tamaru et al. | 368/28 |
| 5,177,712 | 1/1993 | Kakilama | 368/28 |

FOREIGN PATENT DOCUMENTS

| | | |
|---|---|---|
| 27838538 | 4/1905 | Switzerland . |
| 649673 | 6/1988 | Switzerland . |

*Primary Examiner*—Vit W. Miska

*Attorney, Agent, or Firm*—Weil, Gotshal & Manges

[57] ABSTRACT

A timepiece including automatic backward moving display means. Such invention includes: a horometric movement, an intermediate wheel (22) driven by the movement and including driving gear teeth (26a–26y), a display system (16) for information such as the date, at least one oscillating element (30) coupled to the display system (16) and including driven gear teeth (32) in mesh with the driving gear teeth (26a–26y) of the intermediate wheel (22), return means (34) for the oscillating element (30), declutching means (40, 40a) to enable the oscillating element (30) to effect a free backward motion, and an abutment (B) associated with a counter-abutment (CB) in order to limit the backward movement of the oscillating element (30), this invention being characterized in that the counter-abutment (CB) is formed by one (26a) of the driving gear teeth (26a–26y) of the intermediate wheel (22) which, during driving, normally meshes with the driven teeth (32) of the oscillating element (30).

16 Claims, 8 Drawing Sheets

TIMEPIECE OF THE MECHANICAL AND/OR ELECTROMECHANICAL TYPE HAVING AUTOMATIC BACKWARD MOVING DISPLAY MEANS

The present invention concerns a timepiece of the mechanical and/or electromechanical type.

More specifically, it concerns a timepiece including automatic backward moving display means, that is to say, adapted to return in reverse operation towards a point of origin after having effected a predetermined displacement over a course, for example circular in nature.

Displays of this type are employed to provide analogue information such as, for example, hours, minutes, seconds, the date or similar.

Such display means are also known in horology under other denominations such as sectorial or oscillating display means.

BACKGROUND OF THE INVENTION

From patent CH-27961 there is known a timepiece including backward moving display means which permit reading of hours and minutes on circular arcs provided on a dial by means of two hands returning to their point of origin after having attained the respective divisions 12 and 60. Such timepiece responds to the definition given hereinabove.

Such piece includes a first driving intermediate wheel formed by a gear which is controlled by an entirely mechanical horometric movement and which meshes with a toothed sector, itself in mesh with a wheel fixed to a pipe bearing a minutes hand. The hours hand is borne by another pipe which in this case is directly arranged on a sector meshing with a second intermediate wheel.

Each intermediate wheel includes in its thickness a cut-out formed by a notch in the form of a thumbnail. Such notch opens out radially at the periphery of the intermediate wheel near the teeth thereof intended to mesh with the sector.

Thus, after each complete rotation in a first sense referred to as driven sense, the cutout appears facing the sector which is thus liberated from the intermediate wheel and which, thanks to an elastic return means, effects an automatic displacement in a rotation sense opposite to the first. Furthermore, the sector includes an abutment while the intermediate wheel includes a counter-abutment, such abutment and such counter-abutment being formed so as to come into contact in order to limit the angular displacement of the sector and to readjust precisely the corresponding hand onto its original position relative to the dial. The abutment which is provided on the sector is formed by a heel the height of which is twice that of the teeth and thus to that of the body of the sector. The counter-abutment is formed by a tooth of the intermediate wheel which is located above the cutout at a level superior to the gear teeth of the sector.

It is thus understood that the intermediate wheel must exhibit a sufficient thickness in order to be able to accommodate the cutout arranged therein and in order to allow a tooth forming a counter-abutment to remain which is sufficiently rigid in shear to accept the dynamic effort provoked by the contact of the abutment formed by the heel at the end of the displacement in the reverse sense.

It is also understood that the heel itself must exhibit a sufficient thickness or project sufficiently from the gear teeth of the sector in order to come into cooperation with the counter-abutment.

Thus, this arrangement exhibits the primary difficulty of being relatively cumbersome in thickness. Such arrangement had been conceived for application to a timepiece movement such as a large clock and it is the reason for which the designers of that time had not been particularly preoccupied with diminishing the thickness thereof. This arrangement thus may not be incorporated into a modern mechanical and/or electromechanical timepiece in which, as is known, it is furthermore necessary to provide space for other large volume components such as the battery or additional mechanisms for indication of the date, indeed of a chronograph.

Furthermore, this prior arrangement requires machining of the intermediate wheel for effecting the cutout in form of a thumbnail. This special operation as well as that for forming the heel are expensive and increase substantially the price of the timepiece so equipped.

Furthermore, there is known, according to patent CH-143 441, a timepiece one hand of which, in particular that of the hours, is also mounted fixed to a toothed sector which is intended to cooperate with an intermediate wheel in which is arranged a cutout also formed by a notch in the form of a thumbnail directly machined in the intermediate wheel. In this arrangement the abutment and counter-abutment are constituted respectively by a beam of substantial length and by an axis which are respectively mounted on the toothed sector and on the intermediate wheel. The axis is arranged in a tangential fashion to the cutout.

There also, the abutment and the counter-abutment project axially from the sector and from the intermediate wheel and in thickness occupy a substantial amount of space.

Finally, from patent CH-61 478 there is known a date display watch, one hand of which is mounted on a date wheel from which a certain number of teeth are lacking, such wheel being driven in rotation through a pin mounted on an intermediate wheel.

Thus, when the hand has finished its course in the sense of the driven displacement, the pin is located within the cut-away portion formed by the absence of teeth on the date wheel and the motion of such wheel as well as that of the hand are stopped in the absence of meshing with the intermediate wheel. Additionally, the date wheel meshes with a manually operated wheel on which is arranged a bare sector, the diameter of which is substantially identical to the diameter at the tips of the teeth of the manually operated wheel. This latter permits, in view of its bare non-toothed portion, to form an abutment limiting the angular displacement of the date wheel.

Thus, this arrangement is not automatic and necessitates the use of an additional operating wheel which, there as well, increases the costs of manufacture. Furthermore, such wheel does not permit assuring sealing and exposes the movement to dust and impurities since it projects from the case in order to be accessible from the exterior. One may also observe that the intermediate wheel must show a substantial reduction ratio since it must effect one revolution for each step of the date hand, this because of the driving pin.

Thus, the present invention has as its purpose to overcome the difficulties of the prior art mentioned hereinabove in furnishing a timepiece provided with display means having an entirely automatic backward motion and of the least possible thickness in order to diminish the height, in particular, so as to be adapted to equip standard movements of a predetermined thickness.

The present invention has also as purpose to furnish a timepiece of this type, the cost of manufacture and assembly of which are as low as possible.

SUMMARY OF THE INVENTION

To this end, the present invention has as object a timepiece of the mechanical and/or electromechanical type comprising:

a horometric movement, an intermediate wheel driven by the horometric movement and including gear teeth, automatic backward moving display means including:

a display system for information such as the date, for example, at least one oscillating element associated with said display system and including gear teeth, the gear teeth of the intermediate wheel being adapted to come into mesh with the gear teeth of the oscillating element so as to drive it in rotation, the gear teeth of the intermediate wheel and those of the oscillating element being respectively driving and driven teeth, return means for the oscillating element, declutching means for interrupting, in at least a temporary manner, meshing between the driving teeth and the driven teeth and in order to enable the oscillating element to effect a free backward motion, said declutching means being formed by at least one cut-away segment formed in the driving teeth, and an abutment associated with a counter-abutment to limit the backward movement of the oscillating element, said abutment being fixed to the oscillating element while the counter-abutment is fixed to the intermediate wheel, being characterized in that said counter abutment is formed by one of the driving teeth of the intermediate wheel which, during driving, normally meshes with the driven teeth of the oscillating element.

According to a special embodiment, the cut-away segment which constitutes the declutching means as defined in length primarily by two of the driving teeth referred to as end teeth, one of these end teeth forming said counter-abutment.

According to still another characteristic of the invention, the driving tooth forming the counter-abutment shows at least in plan view a form identical to and a thickness equal to those of the other driving gear teeth.

Furthermore, the abutment projects substantially beyond the height of the driven teeth of the oscillating element in order to come into cooperation with the driving gear tooth forming the counter-abutment.

But the invention will be best understood upon reading the detailed following description, taken with reference to the attached drawings which are given solely by way of example.

DESCRIPTION OF THE PREFERRED EMBODIMENTS

Figure 1:
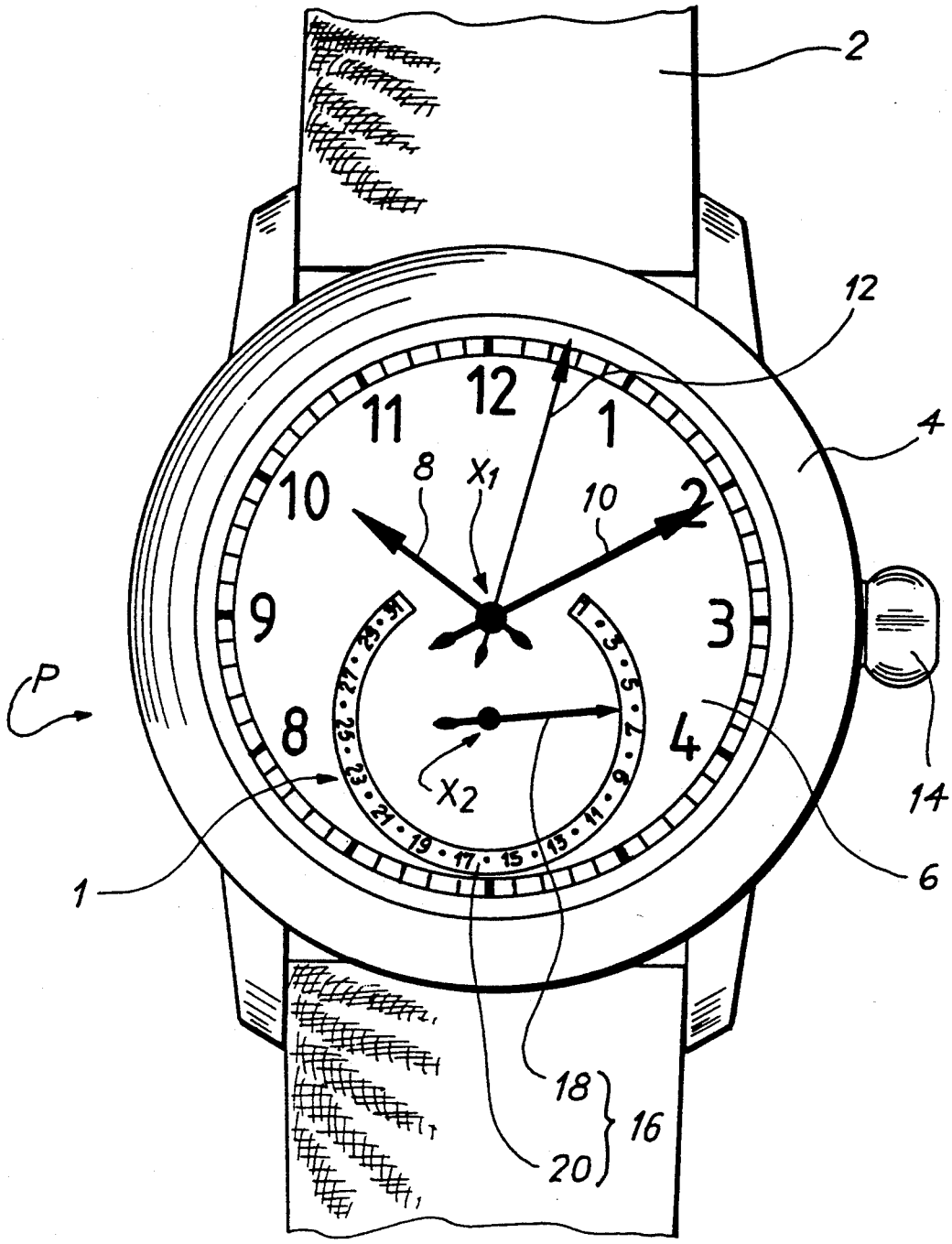
FIG. 1 is a top view of a timepiece including backward moving display means according to the invention.

Referring to FIG. 1, there will be described hereinafter sectorial date display means or display means with backward motion indicated by the general reference 1. The display means 1 which equip a timepiece referenced P are intended to furnish information in an analogue form such as the date and, in particular, the day numbers.

The timepiece P is, in this example, constituted by a wristwatch of the mechanical and/or electromechanical type including a bracelet 2 which here is partially shown and which is assembled on case 4.

The timepiece P includes a dial 6 on which are inscribed in particular hours and minutes indications identified respectively by a first group of numbers 1 to 4 and 8 to 12 and by a graduated circular scale, not referenced. Facing dial 6 are arranged three hands, respectively hours hand 8, minutes hand 10 and seconds hand 12 which are driven by a horometric movement, not shown, assembled in a standard manner in the case 4 and being manually actionable by a crown 14. Hands 8, 10 and 12 may be moved in rotation in a coaxial manner around a first rotation axis X1, centered on the movement of timepiece P.

The sectorial or backward moving display means 1 according to the invention include in a manner visible on this figure, an information display system 16 which is constituted by a hand 18 formed so as to be angularly displacable facing an annular sector 20 on the interior of which are inscribed data and in particular in this example a second group of odd numbers 1 to 31 indicating the day numbers of the month.

As will be understood hereinafter, hand 18, which is kinematically coupled to the horometric movement of the timepiece P, is located in its starting position the first day of the month facing indication 1, and it jumps one step each day, in particular around midnight thanks to means which for the most part are standard and which will not be here described in detail.

In the simplest version of the timepiece according to the invention, the date hand 18 continues its advance until it comes to face FIG. 31 where it attains its final angular displacement position.

Instead of effecting a following step, hand 18 is automatically displaced in the reverse sense towards its original position. Such hand 18 thus effects a backward movement. Such movement being effected solely over a fraction of a revolution, and in particular in this example over an angle of about 330°, it is understood why the display means 1 according to the invention are also qualified as sectorial display means.

Figure 2:
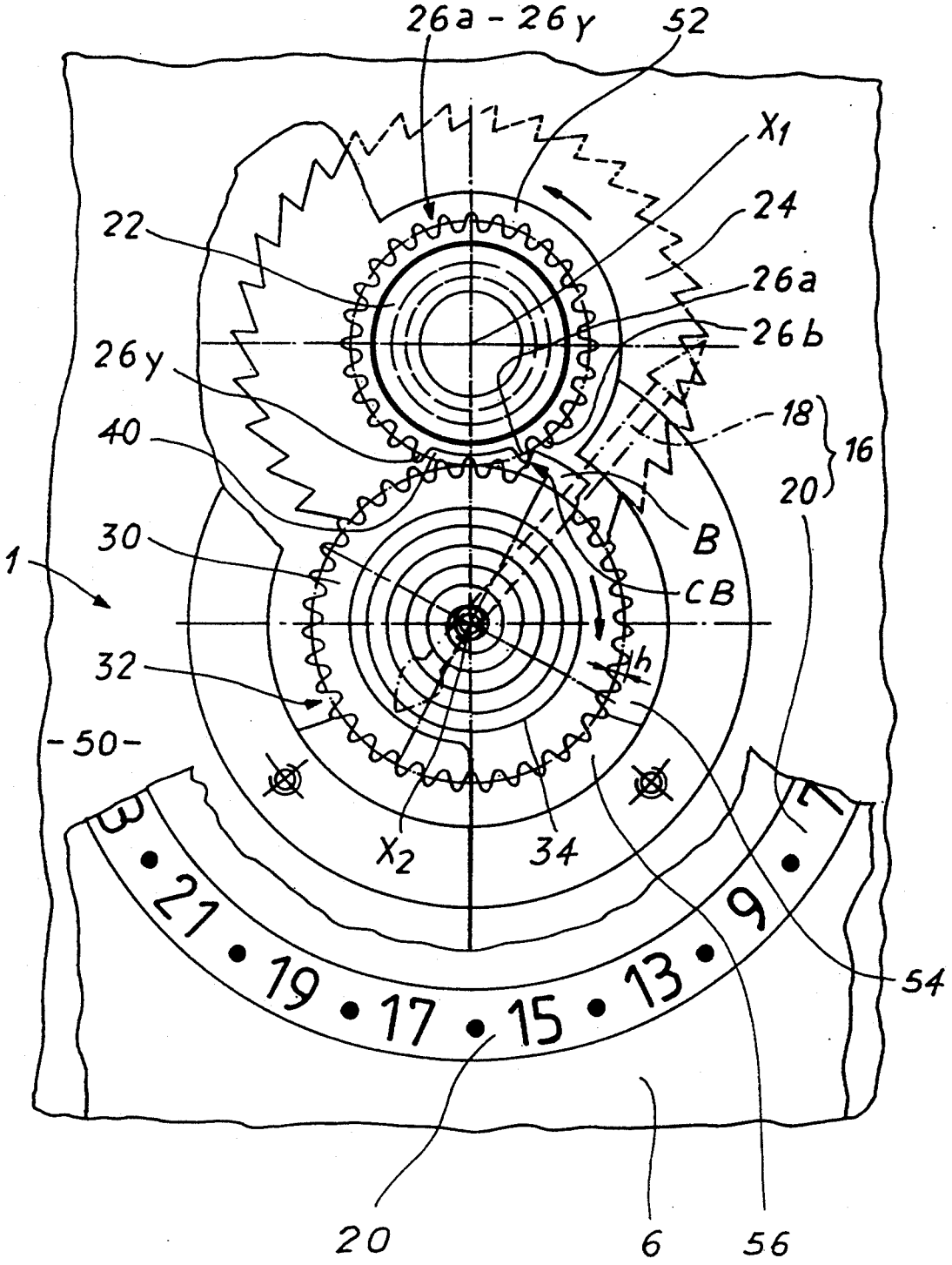
FIG. 2 is top view showing more specifically the display means according to the invention and in which a support plate as well as the dial visible on FIG. 1 are partially shown in a broken-away fashion while a date hand, which is in a starting position (facing number 1) is shown in broken outline.
Figure 3A:
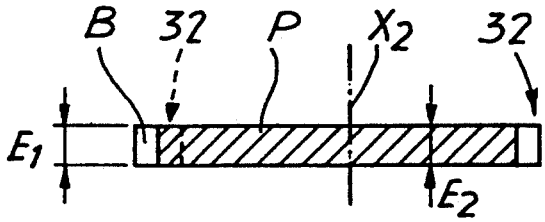
FIG. 3A is a cross-section of an oscillating element according to the invention, taken according to arrows A—A of FIG. 3.
Figure 3:
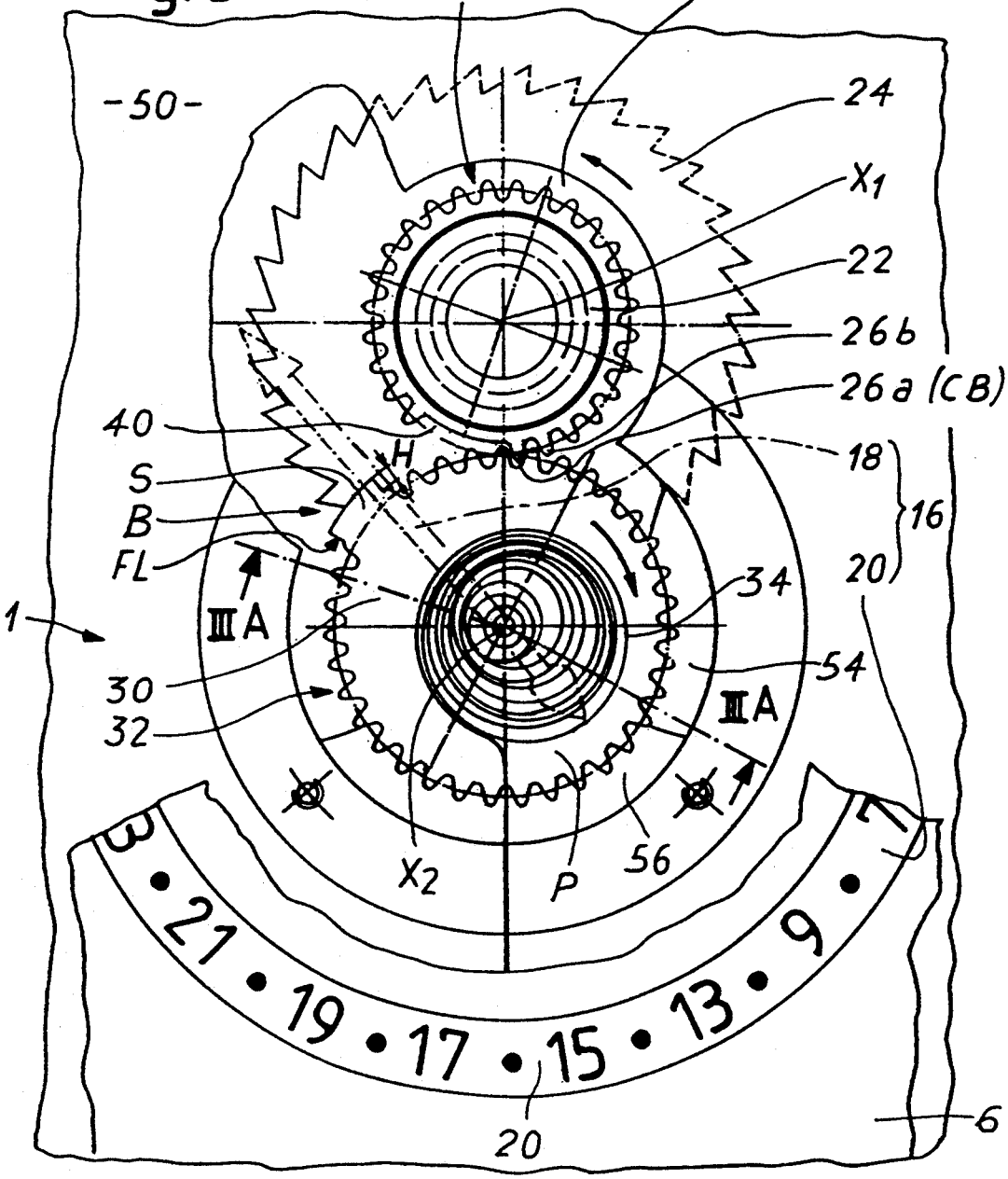
FIG. 3 is a view similar to FIG. 2 but in which the display means are in a more advanced angular position where the date hand is positioned at the end of its course (facing number 31)

Referring hereinafter to FIGS. 2 and 3, there will be described in the most detailed manner the mechanical arrangement of the display means according to the invention.

On these figures, dial 6 as well as a support plate 50 have been shown partially and cut away. There are also found on these figures hand 18 which here is shown in broken outline.

Display means 1 according to the invention include an intermediate wheel or driving pinion 22 which is mounted for rotation around a central axis X1 and which is fixed to a driving star 24 including in this example 31 teeth. Such star is controlled in a standard manner by the horometric movement, not shown, and it is associated with a jumper spring, also well known, and likewise not shown.

The intermediate wheel 22 includes gear teeth **26*a*, 26*b* up to 26*y*, in this example to the number of 25, such teeth being indicated by the general reference 26*a*–26*y* (26*a* to 26*y***).

The sectorial or backward moving display means 1 further include an oscillating element 30 which is associated with the display system 16 through an axis, not referenced, on which is driven hand 18 in a standard manner.

Oscillating element 30 is constituted by a wheel and in particular by a date wheel (same reference) which is mounted for rotation around a second rotation axis X2 separated from the first X1 and which includes gear teeth indicated by the general reference 32.

As may be seen more specifically on FIG. 3, the gear teeth **26*a*–26*y* of intermediate wheel 22 are adapted to come into mesh with the gear teeth 32 of the oscillating element 30 in order to drive it in rotation over a fraction of an angle corresponding to the arc of the annular display sector 20. The motor couple being received from the movement of the timepiece P via intermediate wheel 22, it is understood that the gear teeth 6*a*–26*y* of intermediate wheel 22 and the gear teeth 32 of the oscillating element 30** are respectively driving and driven teeth.

Furthermore, display means 1 include elastic return means for oscillating element 30, such means 34 being constituted by a spiral spring (same reference) one end of which is fixed to the oscillating element 30 in being secured for example on its non-referenced support axis while the other end is maintained fixed relative to the case by being directly secured for example on the support plate 50 shown in greater detail on FIGS. 5 to 8. The return means 34 are arranged in a manner such that oscillating element 30 is elastically returned towards its original position shown on FIG. 2, that is to say, in its backward motion sense (in this example, counter-clockwise).

Display means 1 further include declutching means 40 formed to interrupt in at least a temporary manner meshing between the driving teeth **26*a*–26*y* and driven teeth 32 and, as will be understood, in order to permit the oscillating element 30** to freely effect its return motion.

The declutching means 40 are constituted by a cut-away segment (same reference) formed in the driving teeth **26*a*–26*y*. Such cut-away segment 40 corresponds thus to a zone without teeth forming an annular bare or smooth sector, on intermediate wheel 22**.

Thus, in the position shown on FIG. 2, teeth 32 of the oscillating element 30 are no longer meshing normally with those **26*a*–26*y* of intermediate wheel 22. Thus, when the cut-away segment 40 comes to face the driven teeth 32, the oscillating element 30 is disengaged from its kinematic coupling with intermediate wheel 22** and hence with the horometric movement of the timepiece P according to the invention.

At the same time, oscillating element 30 is permanently elastically urged by spring 34 towards its original position in a counter-clockwise moving sense and its angular displacement in such sense is limited at the original position by an abutment B and by a counter-abutment CB of the display means 1 according to the invention.

Abutment B is fixed to oscillating element 30 while the counter-abutment CB which is formed by one (referenced **26*a*) of gear teeth 26*a*–26*y*, is fixed to intermediate wheel 22**.

Thus, the counter-abutment CB in being constituted by tooth **26*a* of the driving gear teeth 26*a*–26*y* on intermediate wheel 22, normally meshing during driving with driven teeth 32 of the oscillating element 30, does not require any additional machining or assembly operation, in particular on intermediate wheel 22**.

The cut-away segment 40 which constitutes the declutching means shows an arc length, not referenced, primarily defined by two of the driving teeth respectively **26*a* and 26*y* referred to as end teeth, one, 26*a***, of such end teeth forming in particular said counter-abutment CB.

It will be noted on the figures that the driving tooth **26*a* forming the counter-abutment CB has at least in plan view a form identical to that of the other driving gear teeth 26*b* to 26*y*. More specifically, it will be specified that such tooth 26*a* shows a thickness equal to that of the other driving gear teeth 26*b* to 26*y***.

As to the abutment B, this projects substantially beyond the driven teeth 32 of the oscillating element 30 in their height h (FIG. 2) in order to come into cooperation with tooth **26*a*** forming the counter-abutment CB.

It will also be specified that, as is seen on figure 3A, abutment B is arranged primarily in the thickness of the oscillating element 30.

More specifically and as is seen on this figure, abutment B shows a thickness E1 equal to that E2 of teeth 32.

Figure 4:
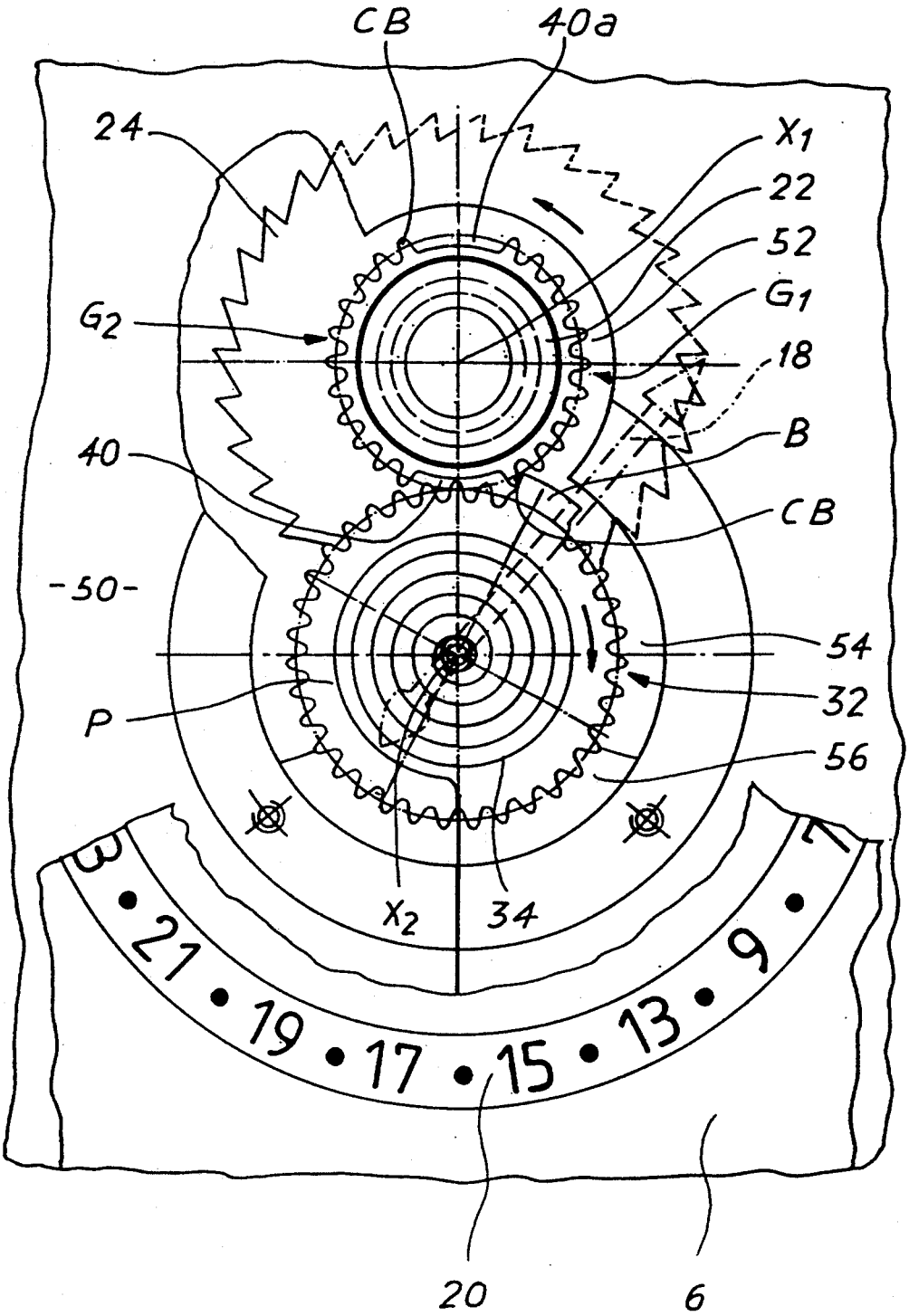
FIG. 4 is a view similar to FIG. 2, but showing a second embodiment of the invention.
Figure 5:
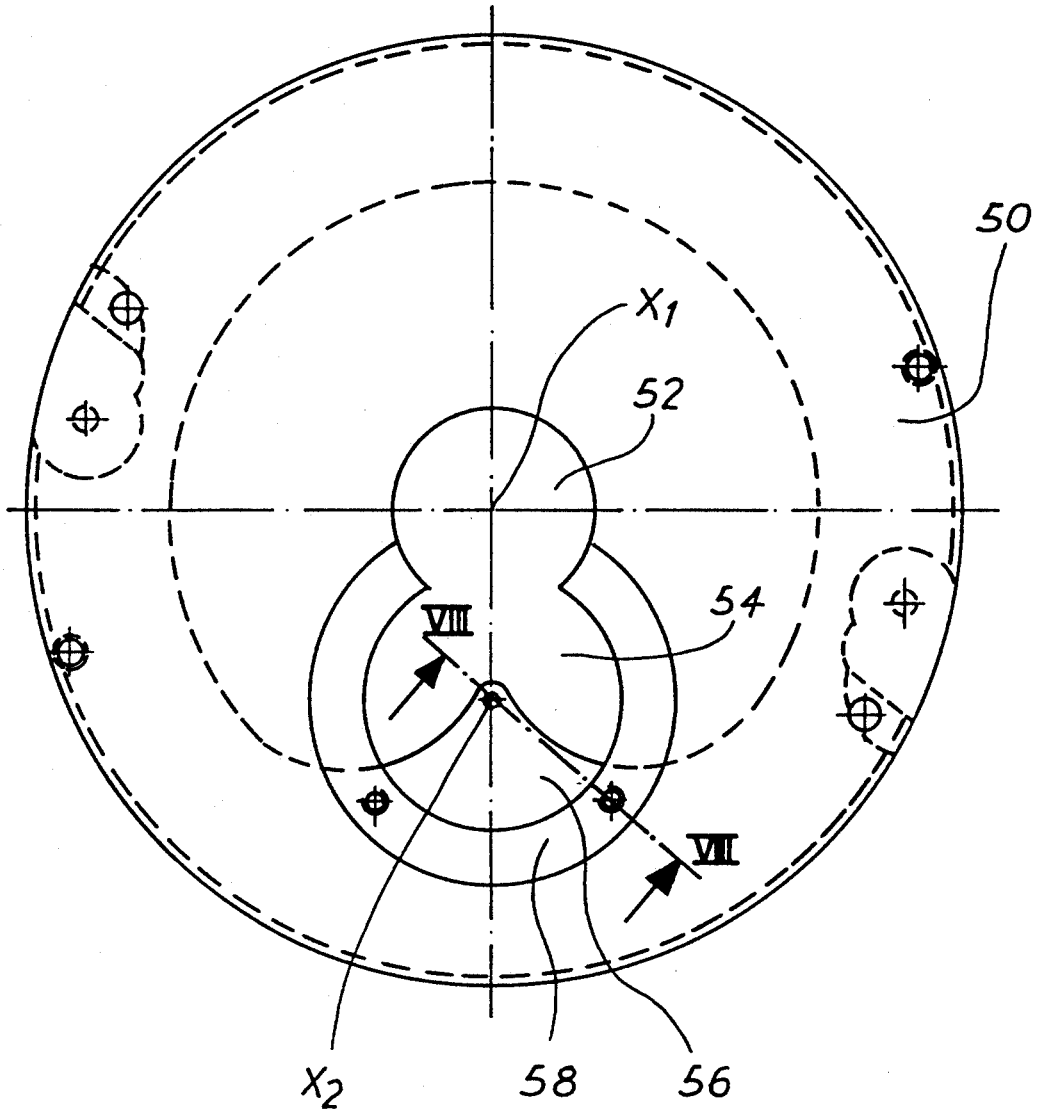
FIGS. 5 and 6 are respectively top and bottom views of the support plate seen partially on FIGS. 2 to 4 and on which are mounted the display means according to the invention.
Figure 6:
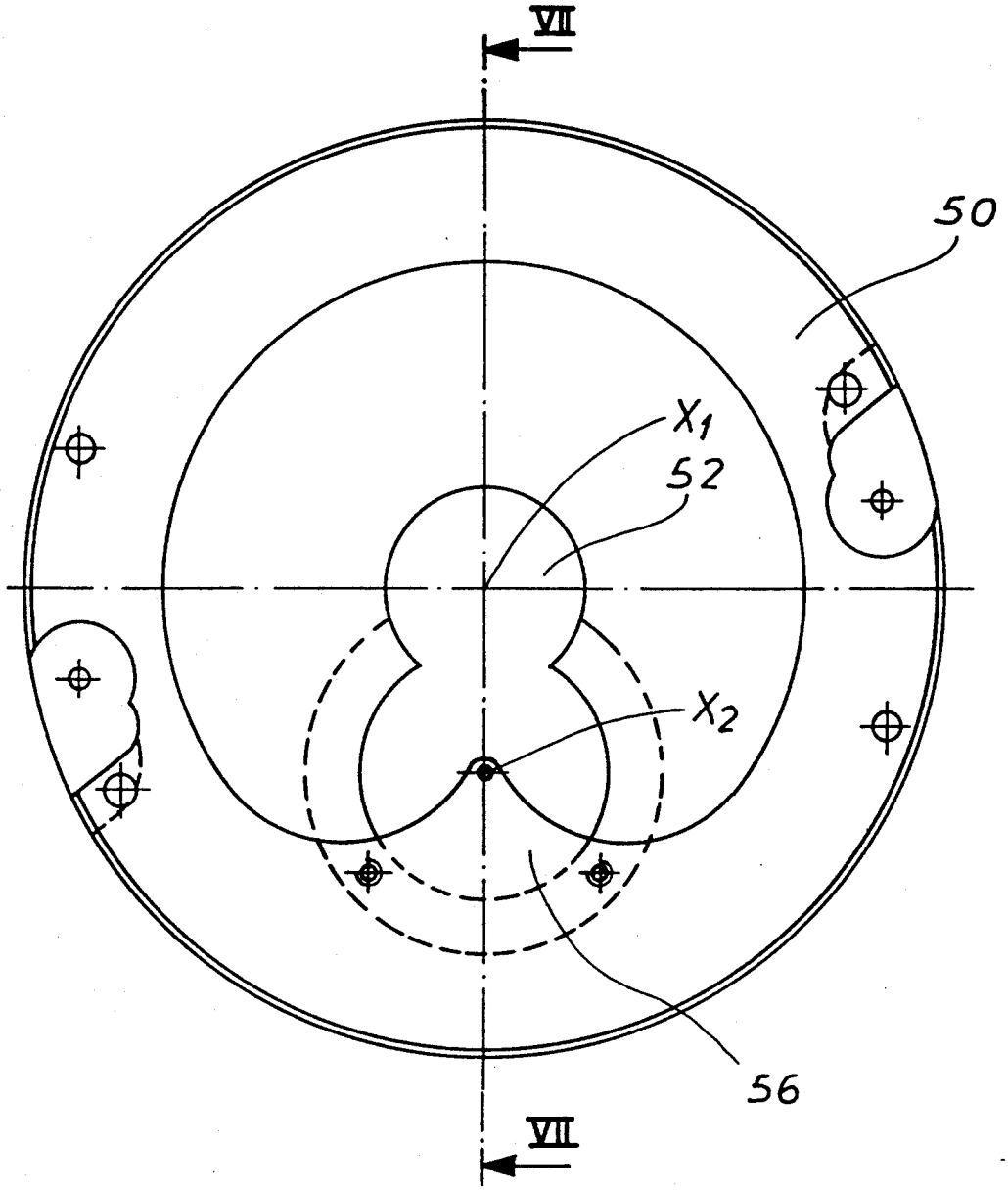
Figure 7:
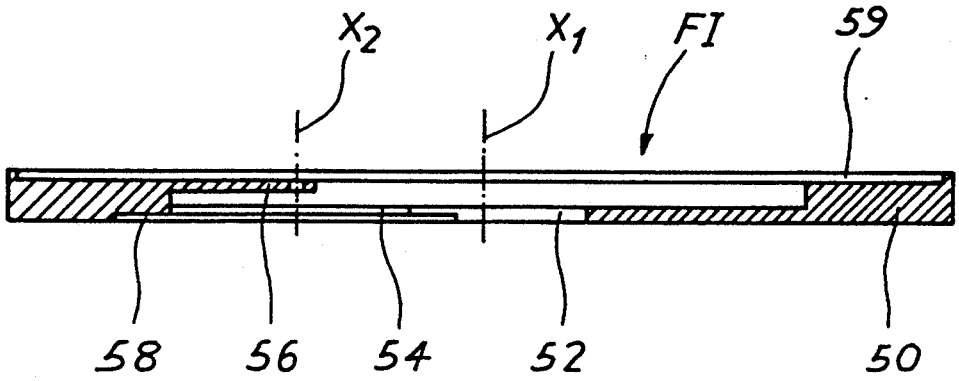
FIGS. 7 and 8 are cross-section views taken respectively according to lines VII—VII and VIII—VIII of FIGS. 6 and 5.
Figure 8:
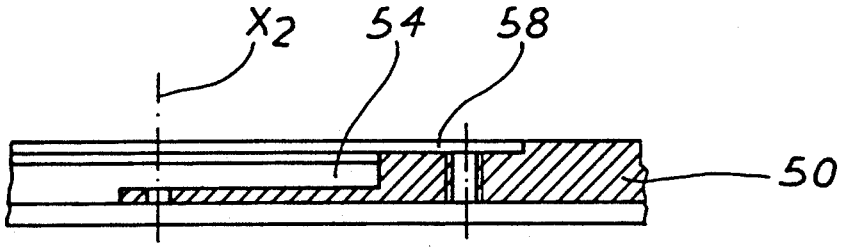

FIG. 4 shows a second embodiment of the invention in which the intermediate wheel 22 includes two groups G1 and G2 of driving teeth, such groups being separated by an equal number of cut-away segments respectively 40 and **40*a*. The angular course of hand 18 is thus here much more limited and this hand effects two advances and returns for a single complete rotation of the intermediate wheel 22**. The number of cut-away segments as well as the number of distinct groups of driving teeth are not limited to two and may be respectively extended to larger numbers.

It may be specified that in all the examples described and as is seen on FIG. 3A, abutment B as well as the driven gear teeth 32 of the wheel forming the oscillating element 30 are cut in the thickness E2 of the plate P forming said wheel. The abutment B may thus be arranged by the same operations of machining and stamping as those necessary to forming teeth 32 without additional operations.

Furthermore and as is seen on FIGS. 2 and 4, abutment B includes a profile showing a lateral re-entrant flank FL (FIG. 3) adapted to cooperate with the driving tooth 26*a* forming the counter-abutment B. Thus, when hand 18 is brought back to its original position following its backward motion, oscillating element 30 is again driven in rotation in the clockwise sense thanks to the action of tooth 26*a* on the re-entrant lateral flank FL.

It is furthermore seen that abutment B is constituted by a segment S projecting from the summit of two half-teeth from the driven teeth 32 of the oscillating element 30.

Abutment B is obtained simultaneously with formation of the driven gear teeth 32 of the oscillating element 30. For this, the wheel forming such oscillating element 30 is cut out to an exterior diameter greater than the diameter at the tips of teeth 32. This additional diameter corresponds to twice the height H (FIG. 3) of abutment B. Thereafter, teeth 32 are formed in plate P with the help of a standard milling cutter, not shown, but only over a given angular portion in order to allow abutment B to remain and to appear in wheel 30.

The invention further includes a support plate 50 shown in a more detailed manner on FIGS. 5 to 8, on which is rotatably mounted the oscillating element 30.

Such support plate 50 is intended to be assembled and secured by its lower face F1 (FIGS. 6 and 7) on a base plate of the horometric movement, not shown, of the timepiece P according to the invention. Such plate 50 includes two cutouts 52 and 54 opening radially into one another. The first cutout 52 receives the intermediate wheel 22 while the second 54 receives the oscillating element 30. To this end the second cutout 54 includes a tongue or projection 56 on the free end of which oscillating element 30 is supported in cantilever and for rotation. Tongue 56 projects diametrally in the second cutout 54 towards the center thereof so as to come into coincidence with the second rotation axis X2.

It will be noted that plate 50 includes a third cutout 59 arranged at the side of face F1 and in which open out axially the other two cutouts 52 and 54.

Figure 9:
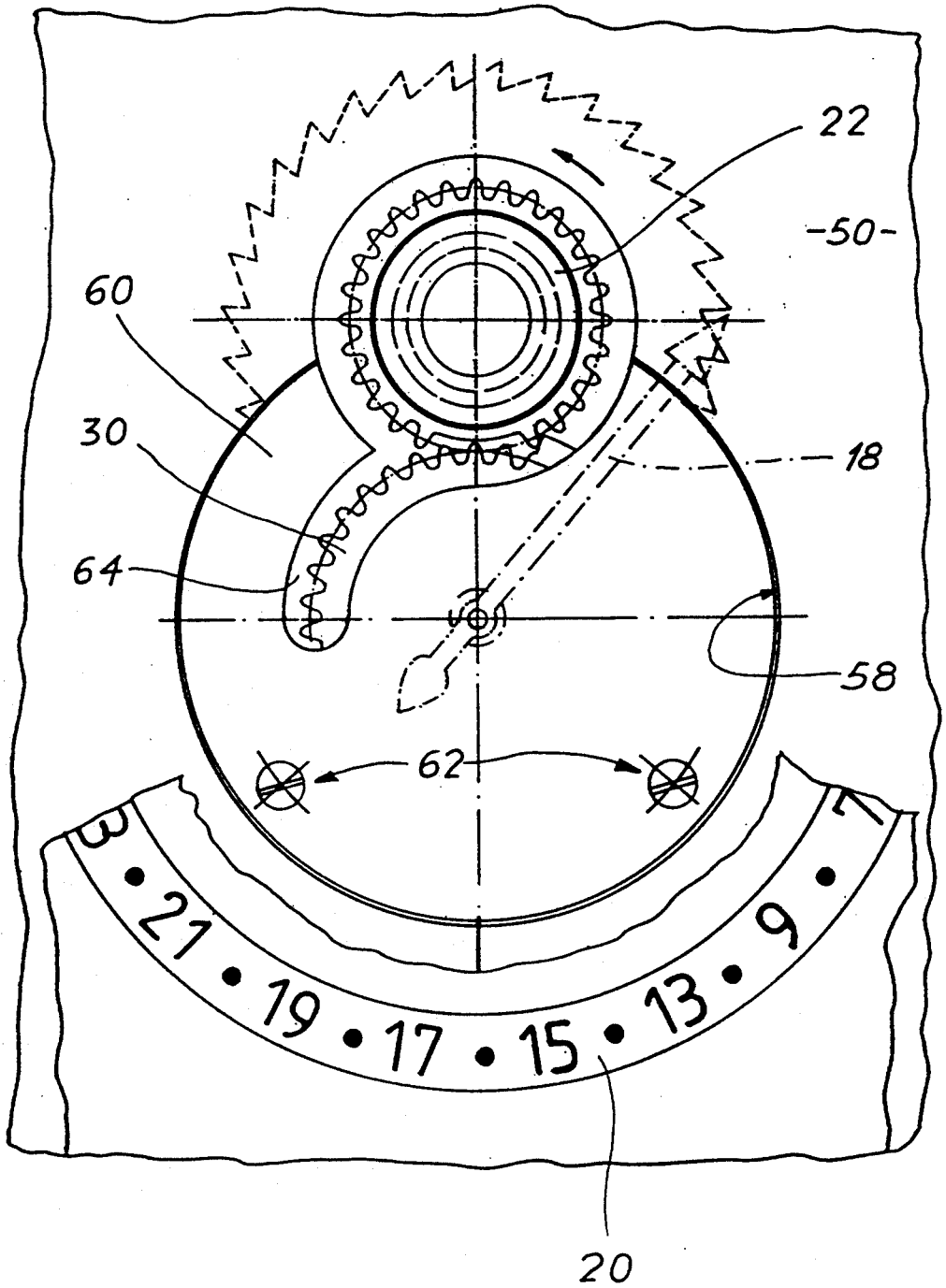
FIG. 9 is a view similar to FIG. 2, but in which the display means according to the invention are covered over by an assembly and maintenance plate.

As is seen on FIG. 9, the invention further includes a second plate 60 fastened onto the first plate 50.

Such second plate 60 is secured by systems of screws and threads 62 above the oscillating element 30 in a fourth cutout 58 provided in the first plate 50, above the second cutout 54 and in a manner coaxial to the latter.

The second plate 60 includes an open circular slot 64 in which there may be introduced a tool, not shown, intended to cock the oscillating element 30 by placing under tension its return means 34.

What I claim is:

1. A timepiece of the mechanical and/or electromechanical type comprising:

a horometric movement, an intermediate wheel driven by the horometric movement and including gear teeth, automatic backward moving display means including:

a display system for information such as the date, for example, at least one oscillating element associated with said display system and including gear teeth, the gear teeth of the intermediate wheel being adapted to come into mesh with the gear teeth of the oscillating element so as to drive it in rotation, the gear teeth of the intermediate wheel and those of the oscillating element being respectively driving and driven teeth, return means for the oscillating element, declutching means for interrupting, in at least a temporary manner, meshing between the driving teeth and the driven teeth and in order to enable the oscillating element to effect a free backward motion, said declutching means being formed by at least one cut-away segment formed in the driving teeth, and an abutment associated with a counter-abutment to limit the backward movement of the oscillating element, said abutment being fixed to the oscillating element while the counter-abutment is fixed to the intermediate wheel, said counter abutment being formed by one of the driving teeth of the intermediate wheel which, during driving, normally meshes with the driven teeth of the oscillating element.

2. A timepiece as set forth in claim 1 wherein the cut-away segment which forms the declutching means has its length defined primarily by two of the driving teeth referred to as end teeth, one of said end teeth forming said counter-abutment.

3. A timepiece as set forth in claim 1 wherein the driving tooth forming the counter-abutment has, at least in plan view, a shape identical to that of the other driving gear teeth.

4. A timepiece as set forth in claim 1 wherein the driving tooth forming the counter-abutment shows a thickness equal to that of the other driving gear teeth.

5. A timepiece as set forth in claim 1 wherein said abutment projects substantially beyond the height of the driven teeth on the oscillating element in order to come into cooperation with the driving gear tooth forming the counter-abutment.

6. A timepiece as set forth in claim 5 wherein said abutment is arranged primarily within the thickness of the oscillating element.

7. A timepiece as set forth in claim 5 wherein said abutment shows a thickness equal to that of the driven gear teeth.

8. A timepiece as set forth in claim 1 wherein said intermediate wheel includes at least two groups of driving teeth separated by an equal number of cut-away segments.

9. A timepiece as set forth in claim 1 in which the oscillating element is a wheel, said abutment and said driven gear teeth on such wheel being cut in the thickness of a plate forming said wheel.

10. A timepiece as set forth in claim 1 wherein said abutment includes a profile showing a re-entrant lateral flank adapted to cooperate with the driving tooth forming the counter-abutment.

11. A timepiece as set forth in claim 1 wherein said abutment is formed by a segment projecting from the summits of two half teeth from the driven teeth of the oscillating element.

12. A timepiece as set forth in claim 1 including at least one support plate intended to be secured onto the horometric movement, such plate including at least two cutouts opening into one another, a first cutout receiving said intermediate wheel and a second cutout receiving the oscillating element, such second cutout including a tongue which projects diametrally therein towards the center thereof, such tongue supporting said oscillating element.

13. A timepiece as set forth in claim 12 wherein said oscillating element is supported in cantilever on the tongue.

14. A timepiece as set forth in claim 13 including a second plate fixed to the first plate above the oscillating element, such second plate including a circular open slot into which a tool may be introduced intended to cock said oscillating element by placing the return means thereof under tension.

15. A timepiece as set forth in claim 2 wherein the driving tooth forming the counter-abutment has, at least in plan view, a shape identical to that of the other driving gear teeth.

16. A timepiece as set forth in claim 6 wherein said abutment shows a thickness equal to that of the driven gear teeth.

* * * * *